United States Patent [19]

Dolan, Jr.

[11] Patent Number: 4,744,377

[45] Date of Patent: May 17, 1988

[54] MASCARA APPLICATOR

[75] Inventor: Howard D. Dolan, Jr., Monroe, N.Y.

[73] Assignee: Avon Products, Inc., New York, N.Y.

[21] Appl. No.: 921,809

[22] Filed: Oct. 20, 1986

Related U.S. Application Data

[63] Continuation of Ser. No. 337,954, Jul. 7, 1982.

[51] Int. Cl.[4] ..... A45D 40/30

[52] U.S. Cl. ..... 132/88.5

[58] Field of Search ..... 132/88.5, 88.7; 401/128, 129, 122

[56] References Cited

U.S. PATENT DOCUMENTS

| | | | |
|---|---|---|---|
| 168,109 | 9/1875 | Sawyer | 401/128 |
| D. 238,212 | 12/1975 | Kingsford | D86/10 A |
| 396,790 | 1/1889 | Wolff | 401/128 |
| 2,007,245 | 7/1935 | Gimonet | 132/88.7 |
| 3,130,735 | 4/1964 | Clark | 132/85 |
| 3,214,782 | 11/1965 | Masters et al. | 401/129 |
| 3,363,635 | 1/1968 | Wurmbock | 132/88.7 |
| 3,892,248 | 7/1975 | Kingsford | 132/88.7 |
| 3,896,823 | 7/1975 | Spatz | 132/88.7 |
| 3,908,676 | 9/1975 | Levine et al. | 132/88.7 |
| 3,998,235 | 12/1976 | Kingsford | 132/88.5 |

*Primary Examiner*—Gregory E. McNeill

*Attorney, Agent, or Firm*—S. Michael Bender

[57] ABSTRACT

A mascara applicator having an applicator head which is a hollow tube having multiple closely spaced slits extending transversely and substantially completely therethrough is described. The applicator head is attached to one end of a shaft having a handle means at its opposite end.

6 Claims, 1 Drawing Sheet

MASCARA APPLICATOR

This application is a continuation of application Ser. No. 337,954 filed Jan. 7, 1982.

BACKGROUND OF THE INVENTION (a) Field of the Invention

This invention relates to an improved mascara applicator. Specifically, this invention relates to a mascara applicator having an applicator head which permits thicker and more complete eyelash coating.

(b) State of the Art

According to conventional practice mascara is applied by dipping a rod-type mascara applicator into a cylinder containing mascara, withdrawing the rod and applying the mascara retained on the rod to the eyelashes. Optimally a mascara applicator should thoroughly coat individual lashes whereby a thickening and lengthening effect is achieved.

A number of heads for mascara applicators have been proposed in the art. These applicator heads generally have a solid core to which brushes or raised elements are attached or comprise grooved rods. See e.g., U.S. Pat. Nos. 3,998,235, 3,130,735, 3,363,635, 3,892,298, 3,896,823, 3,908,676 and Design Pat. No. 238,212. Due to their solid core construction, these prior art applicator heads provide only a thin coating of mascara. This stems both from the limited amount of mascara which the applicator heads can retain and from the wiping effect of the solid core which removes much of the mascara even as it is being applied. Moreover, the prior art applicator heads tend to coat only half the eyelash surface rather than coating its entire circumference.

By means of the applicator of the present invention it is possible to bathe the entire lash in mascara thereby providing a film of mascara over its entire surface. Moreover the hollow core construction of the applicator head of the invention avoids mascara removal associated with solid core applicator heads.

SUMMARY OF THE INVENTION

This invention provides a mascara applicator which thoroughly coats all surfaces of the eyelashes thus maximizing the lengthening and thickening effects of mascara. The coating action is achieved by employing an applicator having a hollow core tubular applicator head. More specifically the applicator comprises a shaft having conventional handle means disposed at one end and the applicator head at the other. The applicator head is a tube having an open core and a plurality of closely spaced transverse slits extending substantially completely therethrough.

DETAILED DESCRIPTION OF THE INVENTION

This invention relates to an improved applicator for mascara. The improvement comprises employing a hollow core applicator head on a conventional rod-type mascara applicator. The applicator comprises handle means attached to one end of a shaft and the applicator head attached to the shaft's other end.

The applicator head has a hollow core and is typically of a circular or elliptical shape in cross-section. Of course, the head may be of any desired cross-sectional shape.

The head is provided with multiple slits or slots which extend less than completely through the longitudinal axis of head. The precise configuration, dimensions and spacing of the transverse slits along the axis of the head depend on the desired application properties. Generally the slits are substantially parallel to one another to permit uniform application of mascara. The slits need not, but may, be perpendicular to the axis of the head.

In order to minimize any possible wiping effect the slits desirably extend substantially completely through the applicator head. However, they cannot extend completely through the head since the structural integrity of the head requires that the segments formed by the slits be joined by some minimal reinforcing member or rod.

Figure 1:
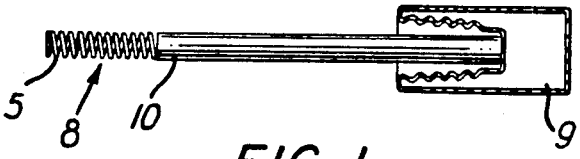
FIG. 1 is a partial sectional longitudinal view of a mascara applicator having a helical spiral head in accordance with the preferred embodiment of the invention.
Figure 2:
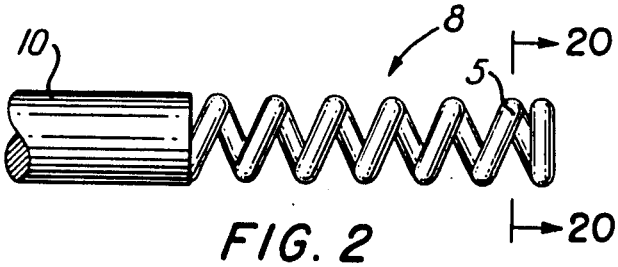
FIG. 2 is an enlarged perspective view of the applicator head of FIG. 1.
Figure 3:
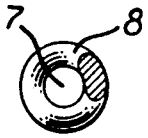
FIG. 3 is a partial sectional view of FIG. 2 along line 20—20.

Referring to FIGS. 1, 2 and 3 which depict the preferred embodiment of the invention, a shaft or rod 10 is attached at one end to handle means, in this case threaded cap 9, while applicator head 8 is attached to the shaft's opposite end. Applicator head 8 is in the form of a helical spiral 5. Opening 7 is filled with mascara upon dipping into a mascara source, thus providing a reservoir of mascara in which the eyelash can be completely immersed.

The mascara composition employed should be of a consistency which permits easy immersion of the lashes therein. On the other hand the mascara should have a viscosity or consistency high enough to be retained within the applicator head. This latter characteristic will be variable according to the size and configuration of the head employed. A mascara having a viscosity of 20 as measured on a Brookfield Helipath TD at 4 rpm has been employed successfully with the invention.

Since the lashes are completely immersed in mascara when the applicator head of the invention is employed, a film of mascara is applied to the entire circumference thereof. The helical spiral in FIG. 2 is the preferred embodiment of the invention in that it maximizes the area which serves as a reservoir for the mascara while minimizing any wiping action of the applicator head.

The coil gauge, shape and number of turns per inch can be adjusted to achieve the desired application properties.

Figure 4:
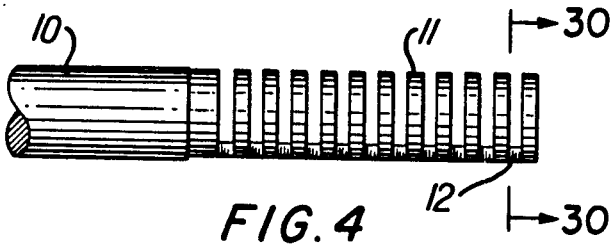
FIG. 4 is an enlarged perspective view of an applicator head in the form of axially spaced concentric parallel rings mounted on a rod.
Figure 5:
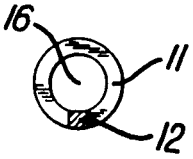
FIG. 5 is a partial sectional view of FIG. 4 along line 30—30.
Figure 6:
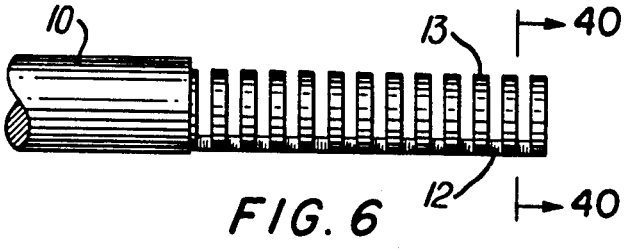
FIG. 6 is an enlarged perspective view of an applicator head in the form of axially spaced concentric parallel rings having openings therein opposite the rod on which they are mounted.
Figure 7:
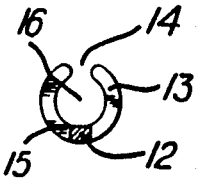
FIG. 7 is a partial sectional view of FIG. 6 along line 40—40.

FIGS. 4 and 5 depict an alternative embodiment of the invention. In this embodiment the applicator head is formed of axially spaced concentric parallel rings 11 mounted on rod 12. A modification of this embodiment is shown in FIGS. 6 and 7 wherein the rings 13 have openings 14 positioned opposite the point 15 where they are mounted on rod 12. The openings 14 facilitate immersion of the lashes in the reservoir of mascara which fills opening 16. In this embodiment, the ring dimensions, shape and spacing can also be adjusted according to desired application properties.

Figure 8:
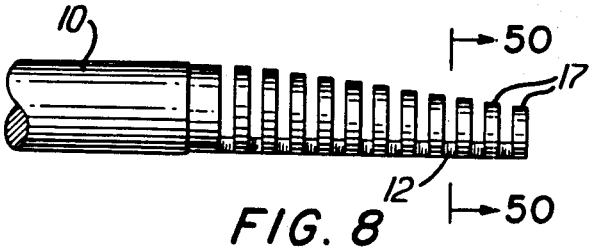
FIG. 8 is an enlarged perspective view of an applicator head formed of concentric parallel rings of diminishing circumference.
Figure 9:
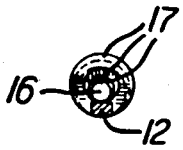
FIG. 9 is a partial sectional view of FIG. 8 along line 50—50.

The applicator heads have been depicted as forming a straight line with the applicator shaft. However, if desired the head may be of a curved configuration. Moreover, the head may taper toward the end opposite that attached to the shaft. For example, FIGS. 8 and 9 depict an applicator head which is the same as that depicted in FIGS. 4 and 5 except that rings 17 progressively diminish in circumference. Such tapering or reduction in circumference of the applicator head can facilitate mascara application to the lashes in the corners of the eyes. Brushes could also be attached to the end of the head to facilitate such application.

Figure 10:
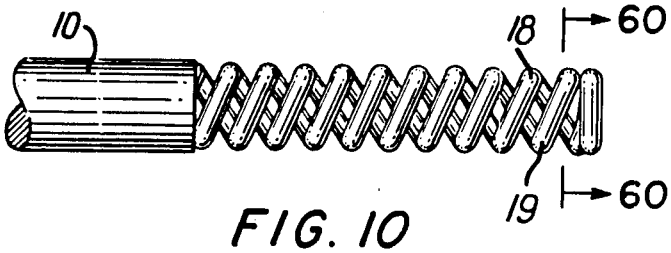
FIG. 10 is an enlarged perspective view of an applicator head formed by a double helical spiral.
Figure 11:
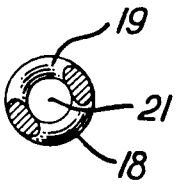
FIG. 11 is a partial sectional view of FIG. 10 along line 60—60.

FIGS. 10 and 11 depict an applicator head which is a modification of that shown in FIGS. 1, 2 and 3. In this embodiment, the applicator head is formed by two wires 18 and 19 which form a parallel helical spiral. Opening 21 is in this case the reservoir. Applicator heads of helical configuration may also be formed using more than two wires.

Typically mascara applicator heads in accordance with the invention will be between 0.25 and 0.90 inches long and between 0.10 and 0.375 inches in diameter. For acceptable mascara application the gauge of the rings or wire will typically be 0.015 to 0.035 inches and the slits will be 0.01 to 0.06 inches wide. Specific embodiments of applicator heads which may be used in the invention have a length of 0.7 inch, a diameter of 0.175 inch, a wire gauge of 0.034 inch, 0.028 inch slits and about 16 turns or rings per inch. These dimensions, of course, are not intended to limit the invention; rather mascara applicator heads of any conventional or suitable dimensions may be employed.

It is to be understood that the applicator head of the invention can be formed of any material which provides at least the minimum rigidity required for application of mascara. Materials such as relatively rigid plastics or metals are obviously acceptable possibilities. Further, the rings or wire which form the applicator head may be round, elliptical, rectangular or of any other desired rounded or flat edged configuration. The surface of the material forming the head may be smooth. However, an increase in the amount of mascara which can be applied with the applicator of the invention might be achieved by employing a rough surfaced applicator head or a head wherein the coil or rings are made of or covered with small bristles.

It is to be understood that the several embodiments shown are illustrative of the invention and that various changes and modifications can be made without departing from the scope of the invention as set forth in the claims.

I claim:

1. A mascara applicator comprising:

(a) a shaft;

(b) handle means attached to one end of said shaft; and (c) an applicator head attached to the other end of said shaft, said head being in the form of a tube having an open core and a plurality of transverse slits extending substantially completely therethrough, said applicator head being attached to said other end of said shaft at one end thereof wherein said applicator head extends from said shaft other end to exclude said shaft from occupying the space defined by said open core, and wherein said slits define a series of applicator elements spaced from each other and from said other end of said shaft in a direction extending away from said other end of said shaft, each of said elements being attached to its neighboring element or elements at a location substantially coinciding with the outside diameter of said tube such that said open core extends commonly through said elements to serve as a resevoir for mascara, and the applicator elements are adapted to apply mascara from said resevoir to substantially coat the entire circumference of an eyelash being wiped thereby as said eyelash is passed between adjacent elements transversely through said commonly extending open core.

2. The applicator of claim 1 wherein the applicator head is a helical spiral.

3. The applicator of claim 1 wherein the applicator head is formed by axially spaced concentric parallel rings mounted on a rod.

4. The applicator of claim 3 wherein each of the rings has an opening at a point opposite the point where the ring is mounted on the rod.

5. The applicator of claim 4 wherein the head tapers toward the end opposite that attached to the shaft.

6. The applicator of claim 1 wherein the head is formed by multiple parallel helical spirals.

* * * * *